US007517246B2

(12) United States Patent
Miyakawa et al.

(10) Patent No.: US 7,517,246 B2
(45) Date of Patent: Apr. 14, 2009

(54) CONNECTOR AND METHOD FOR ASSEMBLING THE SAME

(75) Inventors: Tomoyuki Miyakawa, Shizuoka (JP); Kazuto Ohtaka, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/520,713

(22) Filed: Sep. 14, 2006

(65) Prior Publication Data

US 2007/0072471 A1 Mar. 29, 2007

(30) Foreign Application Priority Data

Sep. 27, 2005 (JP) ..... 2005-280067

(51) Int. Cl.
*H01R 13/40* (2006.01)

(52) U.S. Cl. ..... 439/587; 439/274; 439/260

(58) Field of Classification Search ..... 439/274, 439/260, 587

See application file for complete search history.

(56) References Cited

U.S. PATENT DOCUMENTS 3,818,420 A * 6/1974 Barr ..... 439/261
4,998,896 A * 3/1991 Lundergan ..... 439/595
6,190,203 B1 * 2/2001 Murakami et al. ..... 439/587
6,210,191 B1 * 4/2001 Sai ..... 439/274
6,383,022 B1 * 5/2002 Murakami et al. ..... 439/589
6,494,740 B1 * 12/2002 Murakami et al. ..... 439/587

FOREIGN PATENT DOCUMENTS

JP 2005-28937 2/2005

* cited by examiner

*Primary Examiner*—Truc T Nguyen
(74) *Attorney, Agent, or Firm*—Kratz, Quintos & Hanson, LLP

(57) ABSTRACT

A connector includes a connector housing, a mat seal, an inner cover, and an outer cover. A connector housing includes terminal-receiving chambers for receiving female terminals. The inner cover catches the mat seal with the connector housing and attaches to the connector housing. The outer cover covers the connector housing. The inner and outer covers are connected to each other by a connecting part and attached to the connector housing. A pressing part of a jig for continuity test presses the inner cover into the connector housing. Then, the connecting part is broken and the inner cover 15 is attached to the connector housing.

1 Claim, 5 Drawing Sheets

CONNECTOR AND METHOD FOR ASSEMBLING THE SAME

CROSS REFERENCE TO RELATED APPLICATIONS

This application is based on Japanese Patent Application No. 2005-280067, the contents of which are hereby incorporated by reference.

BACKGROUND OF THE INVENTION

1. Field of the Invention

The present invention relates to a connector used for connecting electric wires and the like.

2. Description of the Related Art

Various electronic devices are mounted on a vehicle. A wiring harness is arranged in the vehicle for supplying electric power and control signals. The wiring harness includes a plurality of electric wires and a connector. The electric wire is so-called a coated wire having a conductive core wire and an insulating cover covering the core wire.

For example, a connector described in Japanese Published Patent Application No. 2005-028937 is used for the connector of the wiring harness. This connector includes a connector housing having a receiving chamber for receiving terminal fittings, a sealer for sealing the terminal-receiving chamber, a fixture for fixing the sealer to the connector housing, and an attachment slidably attached to an outer surface of the connector housing.

The connector housing includes a locking arm for engaging with a mating connector.

The sealer is elastically deformable but plastically deformable. The sealer is formed in a plate shape. A plurality of holes is formed on the sealer for the electric wires attached to the terminal fittings. The sealer is attached to the connector housing with the electric wires through the holes.

The fixture is formed in a thick plate shape. The fixture and the connector housing catch the sealer. Then, the fixture catching the sealer is attached to the connector housing.

The attachment is formed in a tube shape. The attachment having a part of connector housing is slidably attached to the connector housing. A pressing button for releasing the locking arm is mounted on the attachment.

In the Japanese Published Patent Application No. 2005-028937, a downsized connector is disclosed. Canceling a release button can downsize the connector. A lock of this connector is released by sliding the attachment.

Assembling the fixture pressing the sealer makes the connector. Therefore, it is hard to smoothly assemble the sealer to the connector against resilient force of the sealer. The connector described in the Japanese Published Patent Application No. 2005-028937 is not easy to be assembled.

Accordingly, an object of the present invention is to provide a connector and a method for assembling the same, which makes an assembling easy.

SUMMARY OF THE INVENTION

In order to attain the object, according to the present invention, there is provided a connector including:

a connector housing having receiving chambers for terminal fittings;

a sealer having holes for passing electric wires attached to the terminal fittings;

a fixture attached to the connector housing for catching the sealer with the connector housing so as to prevent liquid from entering the receiving chambers; and an attachment disposed on an outer surface of the connector housing, wherein the connector is assembled by the steps of:

molding the fixture and the attachment connected to each other with a connecting part;

attaching the attachment to the outer surface of the connector housing;

receiving the terminal fittings with electric wires in the receiving chambers;

setting the connector to a jig for a continuity test;

breaking the connecting part by the jig pressing the fixture to the connector housing after the continuity test is ended; and assembling the fixture to the connector housing.

According to another aspect of the invention, there is provided a method for assembling a connector having:

a connector housing having receiving chambers for terminal fittings;

a sealer having holes for passing electric wires attached to the terminal fittings;

a fixture attached to the connector housing for catching the sealer with the connector housing so as to prevent liquid from entering the receiving chambers; and an attachment disposed on an outer surface of the connector housing, said method for. assembling the connector including the steps of:

molding the fixture and the attachment connected to each other with a connecting part;

attaching the attachment to the outer surface of the connector housing;

receiving the terminal fittings with electric wires in the receiving chambers;

setting the connector to a jig for a continuity test;

breaking the connecting part by the jig pressing the fixture to the connector housing after the continuity test is ended; and assembling the fixture to the connector housing.

These and other objects, features, and advantages of the present invention will become more apparent upon reading of the following detailed description along with the accompanied drawings.

DETAILED DESCRIPTION OF THE PREFERRED EMBODIMENTS

A connector 1 according to an embodiment of the present invention will be explained with reference to FIGS. 1 to 10. The connector 1 is connected to a mating connector 2 shown in FIGS. 3 and 4.

Figure 1:
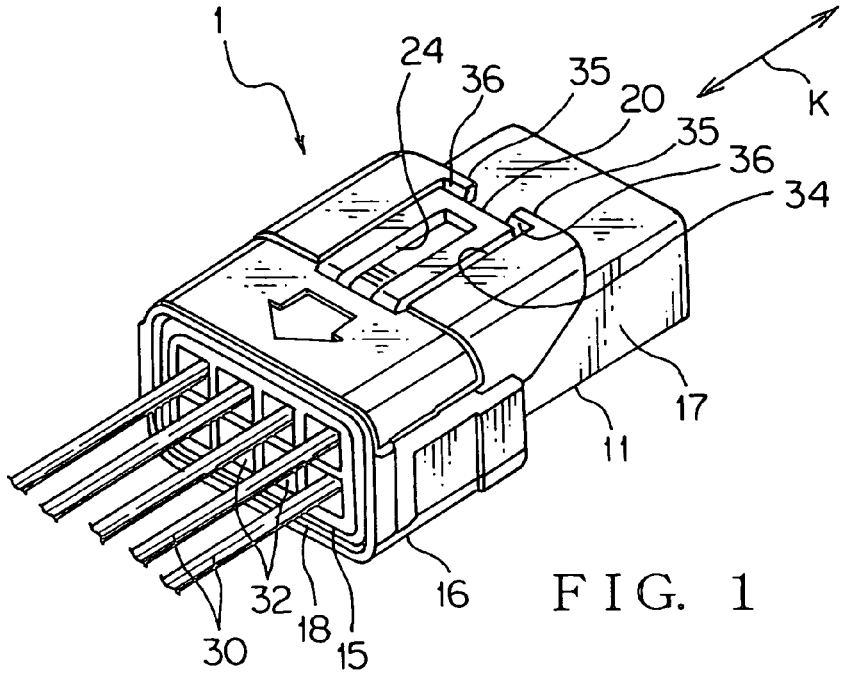
FIG. 1 is a perspective view showing an embodiment of a connector according to the present invention.
Figure 2:
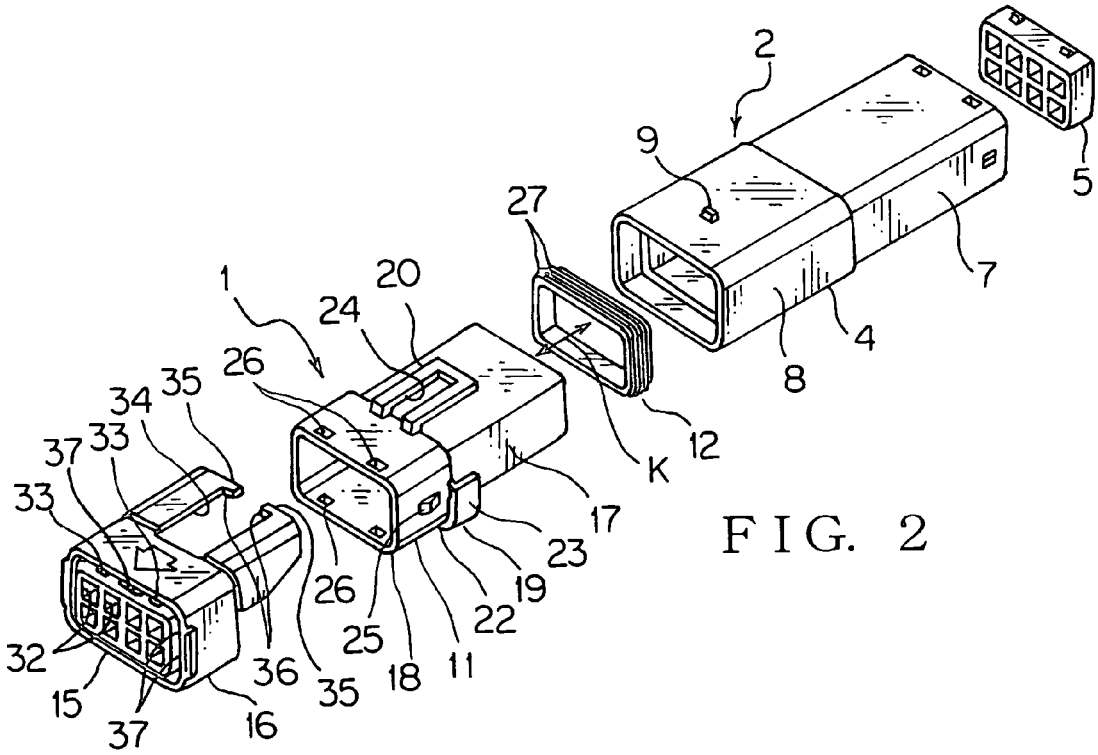
FIG. 2 is an exploded perspective view showing the connector shown in FIG. 1.
Figure 3:
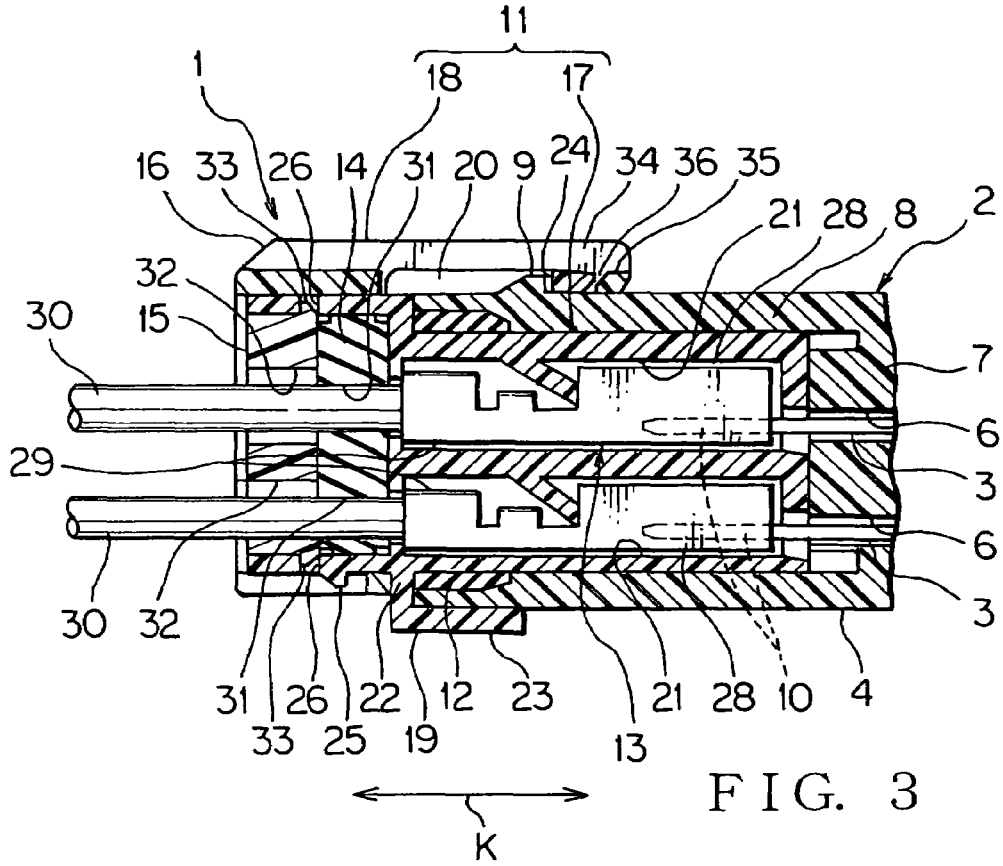
FIG. 3 is a sectional view showing the connector shown in FIG. 1 connected to a mating connector.
Figure 4:
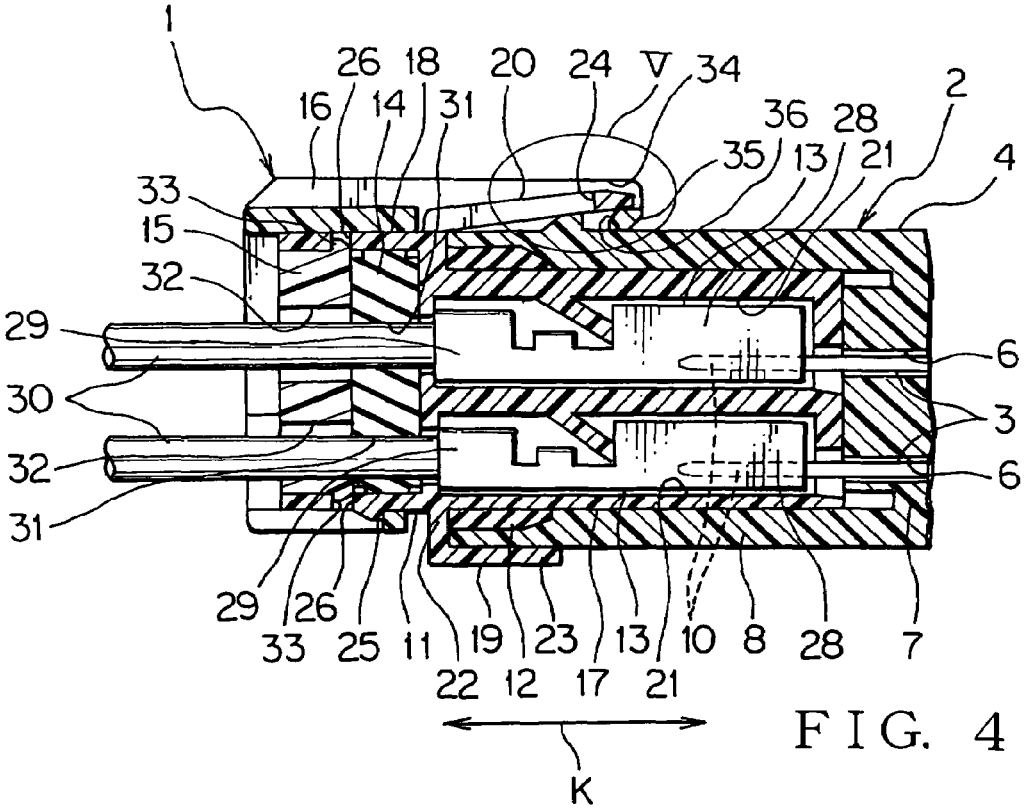
FIG. 4 is a sectional view showing the connector shown in FIG. 3 of which outer cover is slid.

As shown in FIGS. 2 to 4, the mating connector 2 includes a connector housing 4, male terminals 3, a not-shown mat seal, and a seal fixture 5.

The connector housing 4 is made of insulating synthetic resin, and includes a main body 7 having a plurality of receiving chambers 6 for receiving the male terminals 3, and a tubular hood 8 extended from the main body 7. A locking projection 9 is mounted on an outer surface of the hood 8.

The male terminals 3 are made of conductive metal plate. Each male terminal 3 includes a bar-shaped electric contact part 10 and a wire connecting part extended from the electric contact part 10. An electric wire is connected to the wire connecting part. Each male terminal 3 is electrically connected to a core wire of the electric wire. Each male terminal 3 is received in the receiving chamber 6 attached to the connector housing 4 while a top end of the electric contact part 10 is disposed in the hood 8.

The mat seal is made of elastic material such as a rubber, and formed in a plate shape. A plurality of holes for the electric wires connected to the male terminals 3 is mounted on the mat seal. An inner diameter of each hole is larger than an outer diameter of the electric wire while the mat seal is not elastically deformed. The mat seal is overlapped with an end wall of the main body 7 away from the connector 1.

The seal fixture 5 is made of synthetic resin, and formed in a thick plate shape. A plurality of through holes through which the electric wires pass is mounted on the seal fixture 5. The seal fixture 5 is mounted on an end wall of the main body 7 of the connector housing 4 away from the connector 1. The seal fixture 5 catches the mat seal with the main body 7. When the mat seal is caught between the seal fixture 5 and the main body 7, the mat seal is elastically deformed in a direction of thinning the thickness thereof to adhere to the connector housing 4, and elastically deformed in a direction of reducing the inner diameters of the holes to adhere the outer surfaces of the electric wires. The mat seal keeps watertight a boundary between the connector housing 4 and the electric wires and prevents liquid such as water from entering the terminal-receiving chambers 6, namely, the mating connector 2 through the boundary.

The mating connector 2 receives the male terminals 3 with the electric wires in the terminal-receiving chambers 6, and attaches the male terminals 3 to the connector housing 4. After the mat seal is overlapped with the main body 7, the seal fixture 5 presses the mat seal against the main body 7 and the seal fixture 5 is fixed to the connector housing 4.

As shown in FIGS. 1 to 4, the connector 1 includes a connector housing 11, a circular seal 12, and a female terminal 13, and a mat seal 14 as a sealer, and an inner cover 15 as a fixture, and an outer cover 16 as an attachment.

The connector housing 11 is made of insulating synthetic resin, and includes a main body 17, a tubular part 18, an outer flange 19, and a locking arm 20. The main body 17 is formed in a box shape. The main body 17 includes a plurality of terminal-receiving chambers 21 for receiving the female terminals 13.

The terminal-receiving chambers 21 are straightly mounted on the main body 17. Both ends of each terminal-receiving chamber 21 are opened on an outer wall of the main body 17, namely, the connector housing 11. A plurality of terminal-receiving chambers 21 are disposed parallel to each other. When the locking arm 20 is engaged with the locking projection 9, and the connectors 1, 2 are connected to each other, the main body 17, namely the connector housing 11 is inserted into the hood 8 of the mating connector 2.

The tubular part 18 is formed in a rectangular tubular shape, and is continued to the outer wall of the main body 17. The outer flange 19 includes an outer projection 22 and a parallel part 23. The outer projection 22 is projected from the end of the main body 17 near the tubular part 18 to an outside of the connector housing 11. The outer projection 22 is formed along substantially a half around the main body 17. The parallel part 23 is continued to an end of the outer projection 22 away from the main body 17, and extends parallel to the terminal-receiving chambers 21 of the main body 17. The parallel part 23 is extended from the outer projection 22, namely the main body 17 toward the mating connector 2.

One end of the locking arm 20 is extended from the end of the main body 17 near the tubular part 18. The other end of the locking arm 20 is a free end. The locking arm 20 is extended from the one end toward the mating connector 2. A locking hole 24 for receiving the locking projection 9 is formed on the locking arm 20. The locking arm 20 presses the locking projection 9, then is elastically deformed to run onto the locking projection 9, then runs over the locking projection 9 to restore to its original form. Then, the locking projection 9 is positioned in the locking hole 24 so that the locking arm 20 is engaged with the locking projection 9. Thus, the locking arm 20 is engaged with the locking projection 9 to connect the connectors 1, 2 to each other.

Further, a dropout-preventing projection 25 for preventing the outer cover 16 from dropping out of the connector housing 11 is mounted on the outer wall of the tubular part 18 of the connector housing 11. The dropout-preventing projection 25 is projected from the outer wall of the tubular part 18 of the connector housing 11. Further, a hole 26 for locking a later-described locking projection 33 of the inner cover 15 is formed on the tubular part 18 of the connector housing 11. The hole 26 is a through-hole on the tubular part 18.

The circular seal 12 is made of elastic material such as a rubber and formed in a circular shape. The main body 17 of the connector housing 11 is inside the circular seal 12. The circular seal 12 is interposed between the main body 17 and the parallel part 23 of the outer flange 19. The circular seal 12 is mounted around the main body 17. The circular seal 12 has two lips 27 projecting toward the parallel part 23, namely, outward of the connector 1. The lips 27 are mounted around the circular seal 12, namely, the connector 1. When the connectors 1, 2 are connected to each other, the lips 27 are pressed against the connector housing 4 of the mating connector 2 so as to keep watertight a boundary between the connector 1 and the connector housing 4 of the mating connector 2.

The female terminals 13 are formed by folding a conductive metal plate or the like. Each female terminal 13 integrally has a tubular electric contact part 28 and a wire connecting part 29 and extends straight. The electric contact part 10 of the male terminal 3 is inserted into the connecting wall 28, and the electric contact part 10 is electrically and mechanically connected to the connecting wall 28. An electric wire 30 is attached to the wire connecting part 29 and the wire connecting part is electrically connected to the core wire of the electric wire 30. The female terminal 13 electrically connects the electric wire 30 to the male terminal 3.

The mat seal 14 is made of elastic material such as a rubber, and formed in a plate shape. A plurality of holes 31 for the electric wires 30 connected to the female terminals 13 is mounted on the mat seal. An inner diameter of each hole 31 is larger than an outer diameter of the electric wire 30 while the mat seal 14 is not elastically deformed. The mat seal 14 is overlapped with an end wall of the main body 17 away from the mating connector 2.

The inner cover 15 is made of synthetic resin, and formed in a thick plate shape. A plurality of through holes 32 through which the electric wires 30 pass is mounted on the inner cover 15. A plurality of locking projections 33 is mounted on the inner cover 15. The locking projections are projected from an outer wall of the inner cover 15. The locking projections 33 are locked with the holes 26.

By locking the locking projections with the holes 26, the inner cover 15 is attached to an inside of the tubular part 18 of the connector housing 11. The inner cover 15 catches the mat seal 14 with the main body 17 of the connector housing 11. When the mat seal 14 is caught between the inner cover 15 and the main body 17 of the connector housing 11, the mat seal 14 is elastically deformed in a direction of thinning the thickness thereof to adhere to both the main body 17 and the tubular part 18 of the connector housing 11, and elastically deformed in a direction of reducing the inner diameters of the holes 31 to adhere the outer surfaces of the electric wires 30.

The mat seal 14 keeps watertight a boundary between the connector housing 11 and the electric wires and prevents liquid such as water from entering the terminal-receiving chambers 21, namely, the connector 1 through the boundary. Thus, the inner cover 15 is attached to the connector housing 11 and catches the mat seal 14 with the connector housing 11, and the mat seal 14 prevents liquid from entering the terminal-receiving chambers 21.

The outer cover 16 is made of synthetic resin, and formed in a tubular shape. The connector housing 11 is disposed inside the outer cover 16, and the outer cover 16 is attached to the connector housing 11. The outer cover 16 is attached to an end part of the connector housing 11 away from the mating connector 2, namely, outer wall of the tubular part 18. Further, the outer cover 16 is slidably supported in a direction K of connecting the connectors 1, 2 (indicated by an arrow in FIG. 1) by the connector housing 11.

Incidentally, the direction K is a direction where the connector housings 4, 11 are close to each other when the connectors 1, 2 are connected to each other. Therefore, the direction K is parallel to the male terminals 3, the female terminals 13, and the electric wires 30 attached to the terminals 3, 13.

A notch 34 is formed on an end of the outer cover 16 near the mating connector 2. The locking arm 20 is disposed inside the notch 34. The notch 34 allows the locking arm 20 to be elastically deformed. Further, releasing projection 35 is mounted on an end of the notch 34 near the mating connector 2.

The releasing projection 35 is projected from the notch 34 closer to the mating connector 2 than the locking arm 20. Further, the releasing projection 35 is mounted parallel to the locking arm in the direction K. A tapered wall 36 is formed on the releasing projection 35. When the outer cover 16 is slid in a direction away from the mating connector 2, the tapered wall 36 contacts the locking arm 20. The tapered wall 36 is mounted on an end of the releasing projection 35 away from the mating connector 2. The tapered wall 36 is tapered in a direction of approaching the connector housing 11 as moving away from the mating connector 2 against the direction K.

When sliding the outer cover 16 in a direction of moving away from the mating connector 2, because the tapered wall 36 is tapered, the releasing projection 35 positions the free end of the locking arm 20 on the tapered wall 36, and elastically deforms the locking arm 20 so that the free end moves outside of the connector housing 11. The outer flange 19 and the dropout-preventing projection 25 regulate a slidable range of the outer cover 16. Namely, the outer cover 16 slides between the positions contacting the outer flange 19 and the dropout-preventing projection 25.

The above-described connector 1 is assembled in a manner described below. First, as shown in FIG. 2, the outer cover 16 and the inner cover 15 are previously molded in a manner they are connected by a connecting part 37. The connecting part 37 is formed in a bar shape in a manner that both ends thereof are continued to the covers 15, 16. Next, the mat seal 14 is attached to the inside of the tubular part 18 of the connector housing 11, and the outer and inner covers 15, 16 connected by the connecting part 37 is attached to the tubular part 18. Namely, the outer cover 16 is attached to an outer wall of the connector housing 11. Thus, the mat seal 14 is interposed between the main body 17 and the inner cover 15. Then, the terminal-receiving chambers 21 receive the female terminals with the electric wires 30 through the through holes 32 of the inner cover 15 and through the holes 31 of the mat seal 14. Thus, the female terminals 13 are attached to the connector housing 11.

Figure 6:
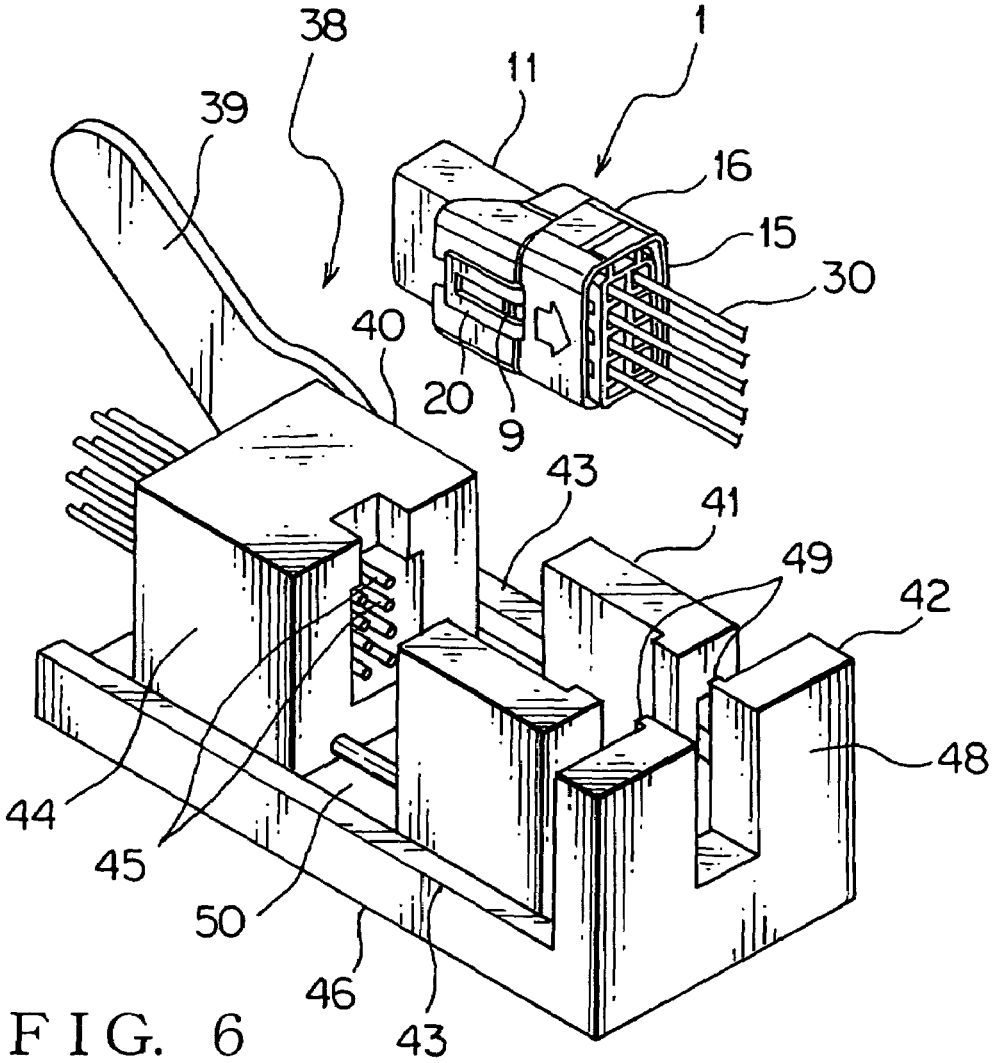
FIG. 6 is a perspective view showing a jig of a continuity test for the connector shown in FIG. 1.

Then, the connector housing 11, namely, the connector 1 is set on a jig 38 for continuity test (shown in FIG. 6).

As shown in FIG. 6, the jig 38 for continuity test includes a base 46 setting on a table, an operational lever 39, a continuity test part 40, a not-shown link, a connector receiver 41, and a pressing member 42.

The base 46 includes a rectangular bottom plate 50, and a pair of sidewalls 43 parallel to each other and extending from both edges of the bottom plate 50 in a width direction thereof. The operational lever 39, the continuity test part 40, and the connector receiver 41 are mounted in between the pair of sidewalls 43.

An end of the sidewalls 43 of the base 46 rotatably supports the operational lever 39. The continuity test part 40 is mounted on the end of the sidewalls 43 of the base 46. The continuity test part 40 includes a test main body 44 and a plurality of test pins 45. The test main body 44 is formed in a box shape. The test main body 44 is interposed between the pair of the sidewalls 43 slidably in a direction of approaching and moving away from the connector receiver 41.

The test pins 45 are embedded in the test main body 44. The number of the test pins 45 is the same as that of the terminal-receiving chambers 21 of the connector 1 to be received by the connector receiver 41. The test pins 45 is pressed toward the connector receiver 41. The test pins 45 are connected to a continuity test apparatus through electric wires.

One end of the link is rotatably connected to the operational lever 39, and the. other end of the link is rotatably connected to the test main body 44 of the continuity test part 40. When the lever 39 is operated, the link makes the continuity test part 40 touch or remove the connector receiver 41.

The connector receiver 41 is disposed in the center of the sidewalls 43 of the base 46. The connector receiver 41 holds the connector 1 in a manner that openings of the terminal-receiving chambers 21 face the operational lever 39. In the figures, the connector 1 is vertically insertable into the connector receiver 41.

Further, the connector receiver 41 is slidably mounted on the base 46 in a longitudinal direction thereof. The connector receiver 41 is slidably mounted across the center and the other end of the sidewalls 43, namely the base 46. The connector receiver 41 is pressed toward the one end of the base 46.

The pressing member 42 is interposed between the other ends of the pair of the sidewalls 43, and includes a U-shaped main body 48 and pressing parts 49. The electric wire 30 of the connector 1 held by the connector receiver 41 is passed through an inside of the pressing member 42. The pressing parts 49 are projected from inner edges of the main body 48 toward the connector receiver 41. The pressing parts 49 contact the inner cover 15 of the connector 1 held by the connector receiver 41 when the connector receiver 41 is moved close to the pressing member 42.

When setting the connector 1 to the jig 38 for continuity test, by operating the lever 39, the continuity test part 40 is positioned at the nearest part of the one end of the base 46. After setting the connector 1 to the connector receiver 41, by operating the lever 39, the continuity test part 40 is moved close to the connector receiver 41. Then, the test pins 45 of the continuity test part 40 contact the female terminals 13 in the connector 1. At this time, the connector receiver 41 is not moved relative to the base 46. Then, the continuity test apparatus tests the connector 1 through the test pins 45 by such as applying current to the female terminals 13.

Figure 7:
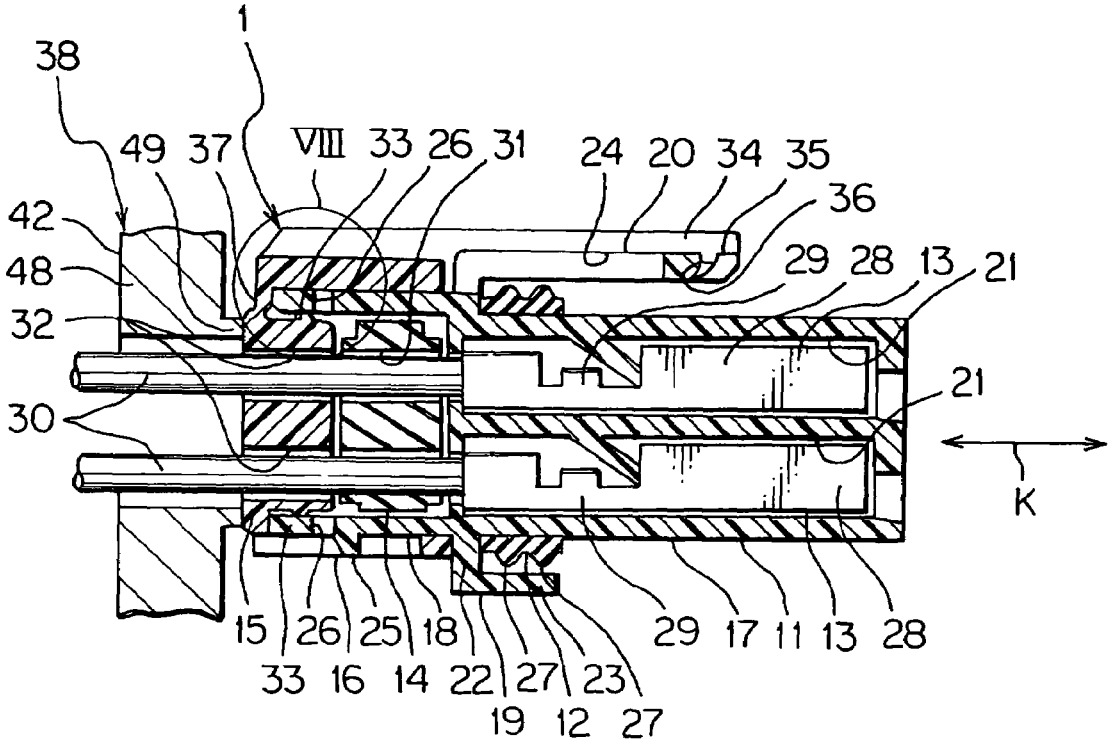
FIG. 7 is a sectional view showing the connector set in the jig of the continuity test, of which inner cover is pressed by a pressing member.
Figure 8:
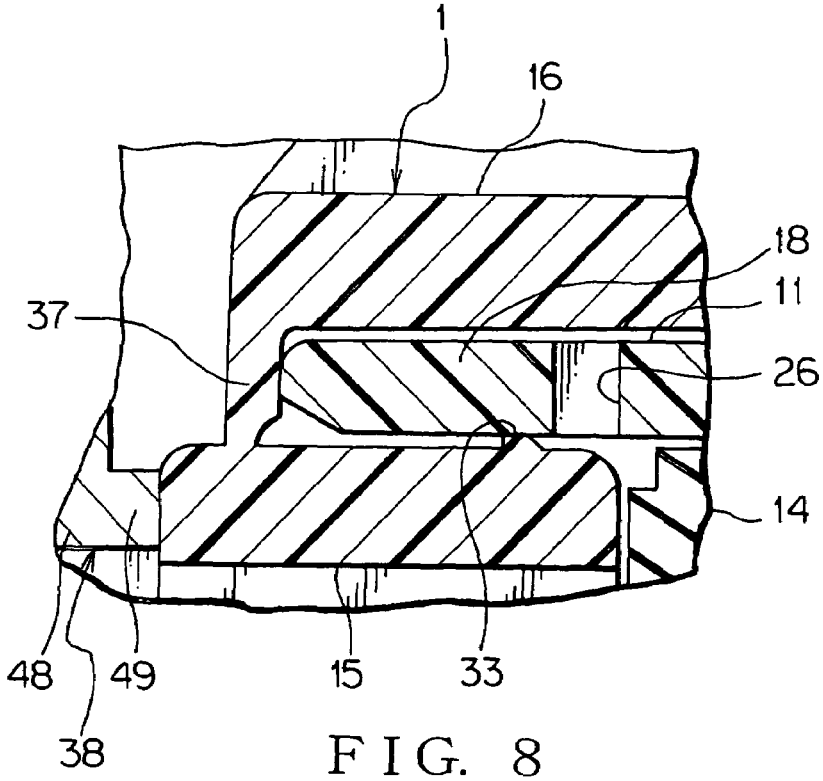
FIG. 8 is an enlarged sectional view showing VIII in FIG. 7.
Figure 9:
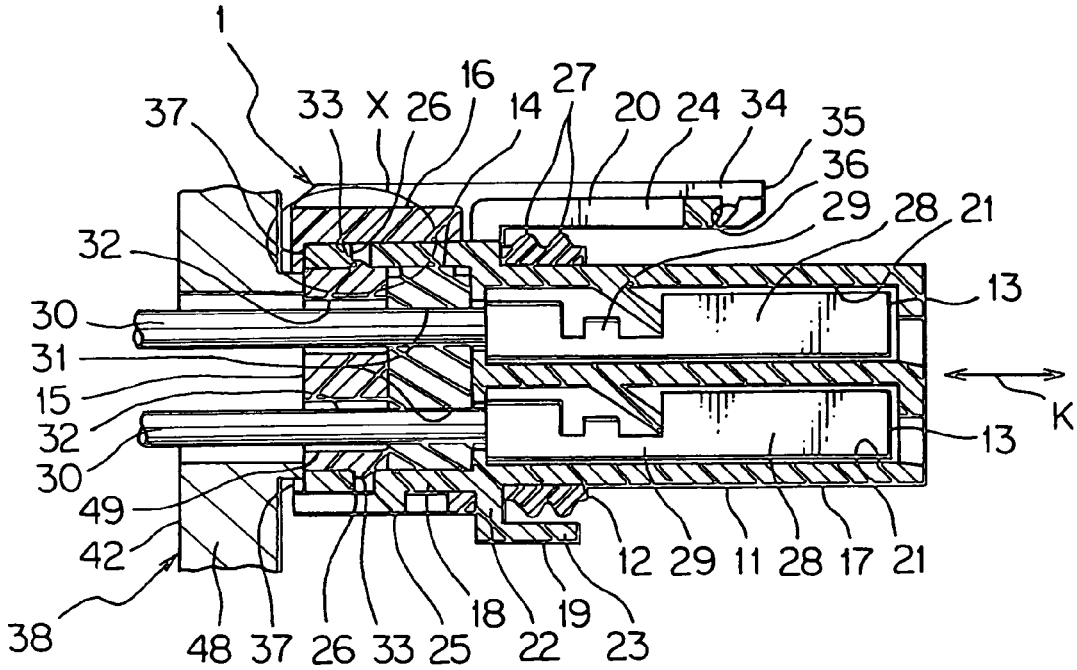
FIG. 9 is a sectional view showing the connector of which connecting part is broken by the pressing member shown in FIG. 7 pressing the inner cover.
Figure 10:
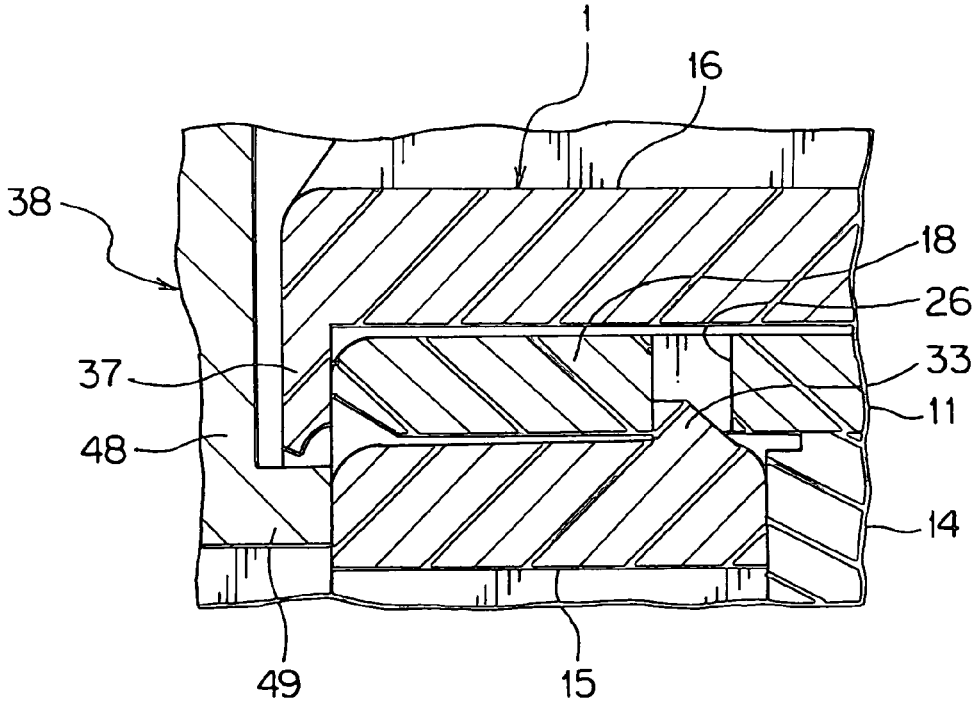
FIG. 10 is an enlarged sectional view showing X in FIG. 9.

When judging good in the continuity test, by operating the lever 39, the continuity test part 40 and the connector receiver 41 are slid toward the pressing member 42. Then, as shown in FIGS. 7 and 8, the inner cover 15 contacts the pressing part 49 of the pressing member 42. Further, by operating the lever 39, the continuity test part 40 and the connector receiver 41 are slid toward the pressing member 42. Then, the pressing part 49 of the pressing member 42 presses the inner cover 15 toward an interior of the tubular part 18 of the connector housing 11 so that the connecting part 37 is broken. Then, as shown in FIGS. 9 and 10, the inner cover 15 is pressed into the tubular part 18 of the connector housing 11, and the locking projection is locked on the hole 26, so that the inner cover 15 is fixed to the connector housing 11. Thus, after the continuity test, the pressing member 42, namely the jig 38 presses the inner cover 15 against the connector housing 11, and the connecting part 37 is broken, so that the inner cover 15 is attached to the connector housing 11.

Figure 5:
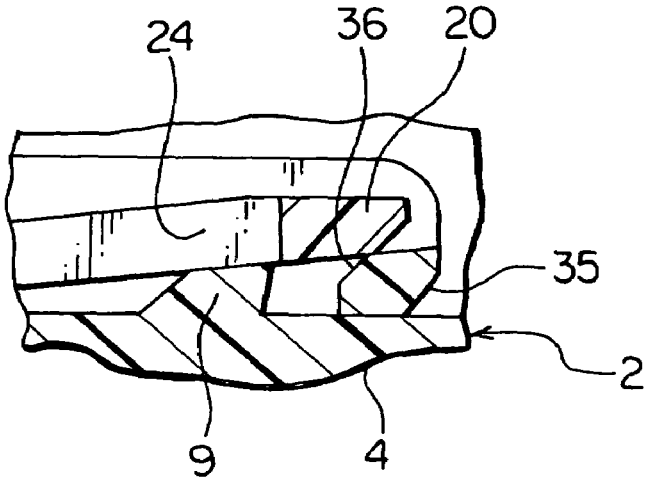
FIG. 5 is an enlarged sectional view showing V in FIG. 4.

Then, by operating the lever 39, the continuity test part 40 is positioned closest to the one end of the base 46, and the connector 1 is removed from the connector receiver 41. Then, as shown in FIG. 3, the connector 1 is connected to the mating connector 2. When disconnecting the connectors 1 and 2, the outer cover 16 is moved away from the mating connector 2. Then, as shown in FIGS. 4 and 5, the locking arm 20 is moved onto the tapered wall 36 of the releasing projection 35 so that the engagement between the locking arm 20 and the locking projection 9 is canceled. Thus, the connection between the connector 1 and the mating connector 2 is canceled.

According to the present invention, because the outer cover 16 connected to the inner cover 15 by the connecting part 37 is attached to the connector housing 11, when the outer cover 16 is attached to the connector housing 11, the inner cover 15 is positioned. Therefore, even when the inner cover 15 is pressed against the connector housing 11, and the resilient force of the mat seal 14 works, a disposition of the inner cover 15 relative to the connector housing 11 is prevented. Accordingly, the inner cover 15 is easily attached to the connector housing 11, and the connector 1 is easily assembled.

Further, because the connector housing 11 is set to the jig 38 and the inner cover 15 is pressed after the continuity test, a process for fixing the inner cover 15 to a predetermined position is done at a process for the continuity test. Thus, the number of the processes for assembling the connector 1 is not increased.

According to the present embodiment, the engagement of the locking projection 9 of the locking arm 20 is released by sliding the outer cover 16. However, according to the present invention, the engagement of the locking projection 9 may not released even when the cover 16 is slid. Further, the sealing members the fixing members and attaching members may be varied within a scope of the present invention.

Further, according to the present invention, the pressing part for pressing the inner cover may be mounted on a rear side of the connector receiver 41 of the jig 38, and corresponding to a test result of the continuity test part 40, the pressing part may press the inner cover 15 automatically. Further, a stopper mechanism for stopping the slide of the connector receiver 41 temporarily at the continuity test position, and pressing the inner cover 15 corresponding to the test result may be mounted.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A connector comprising:

a connector housing, having receiving chambers for terminal fittings;

a sealer having holes for passing electric wires attached to the terminal fittings;

a fixture attached to the connector housing for catching the sealer with the connector housing so as to prevent liquid from entering the receiving chambers;

an attachment disposed on an outer surface of the connector housing; and a connecting part connecting the fixture and the attachment to each other which is broken by a jig pressing the fixture to the connector housing after a continuity test in ended.

* * * * *